US011517908B2

(12) United States Patent
Peltonen et al.

(10) Patent No.: US 11,517,908 B2
(45) Date of Patent: Dec. 6, 2022

(54) CRUSHER FRAME

(71) Applicant: Metso Outotec Finland Oy, Tampere (FI)

(72) Inventors: Mika Peltonen, Tampere (FI); Petri Kujansuu, Tampere (FI)

(73) Assignee: Metso Outotec Finland Oy, Tampere (FI)

( * ) Notice: Subject to any disclaimer, the term of this patent is extended or adjusted under 35 U.S.C. 154(b) by 154 days.

(21) Appl. No.: 15/756,766

(22) PCT Filed: Sep. 14, 2015

(86) PCT No.: PCT/FI2015/050603
§ 371 (c)(1),
(2) Date: Mar. 1, 2018

(87) PCT Pub. No.: WO2017/046437
PCT Pub. Date: Mar. 23, 2017

(65) Prior Publication Data

US 2018/0264477 A1 Sep. 20, 2018

(51) Int. Cl.
*B02C 2/04* (2006.01)

(52) U.S. Cl.
CPC ..... *B02C 2/04* (2013.01)

(58) Field of Classification Search
CPC .... B02C 2/00; B02C 2/02; B02C 2/04; B02C 2/042; B02C 2/045; B02C 2/047; B02C 2/06; B02C 2/10; B02C 2002/002; B02C 7/08; B02C 7/184; B02C 13/014; B02C 13/1807; B02C 13/24; B02C 18/08; B60B 1/00; B60B 9/00; B60B 25/00; B60B 25/002; B60B 25/02; B60B 27/00; B21D 53/30; B01F 5/0071; B01F 5/0074; B01F 5/221; B01F 5/226; B01F 5/228;
(Continued)

(56) References Cited

U.S. PATENT DOCUMENTS 2,832,547 A * 4/1958 Kennedy ..... B02C 2/06 241/209
8,070,084 B2 * 12/2011 Biggin ..... B02C 2/04 241/209
(Continued)

FOREIGN PATENT DOCUMENTS

EP 2647439 A1 10/2013
EP 2821140 A1 * 1/2015 ..... B02C 2/04
(Continued)

OTHER PUBLICATIONS

Notice of Allowance for Japanese Patent Application No. 2018-512129 dated Mar. 9, 2019.
(Continued)

*Primary Examiner* — Shelley M Self
*Assistant Examiner* — Smith Oberto Bapthelus
(74) *Attorney, Agent, or Firm* — Andrus Intellectual Property Law, LLP

(57) ABSTRACT

A mineral material processing plant, a crusher and an upper frame for a crusher. The upper frame includes a central hub for receiving a main shaft of the crusher, an upper rim, and a spider arm. A u-shaped cavity extends towards a lower flange from the upper rim.

12 Claims, 8 Drawing Sheets

(58) Field of Classification Search
CPC .... B01F 7/16; B01F 7/186; B01F 7/30; B01F 2009/0061; B01F 9/10
USPC ..... 241/209, 210, 211, 212, 213, 214, 215, 241/216; 464/134; 74/606 R
See application file for complete search history.

(56) References Cited

U.S. PATENT DOCUMENTS

| | | | | |
|---|---|---|---|---|
| 2004/0035967 | A1* | 2/2004 | Johnson | B02C 2/005 241/207 |
| 2007/0272780 | A1 | 11/2007 | Olsson et al. | |
| 2011/0192927 | A1* | 8/2011 | Biggin | B02C 2/04 241/213 |
| 2013/0277469 | A1* | 10/2013 | Viilo | B02C 2/007 241/30 |
| 2017/0304832 | A1* | 10/2017 | Hallberg | B02C 2/045 |

FOREIGN PATENT DOCUMENTS

| | | | |
|---|---|---|---|
| EP | 2821140 | A1 | 1/2015 |
| EP | 2859951 | A1 | 4/2015 |

OTHER PUBLICATIONS

International Search Report and Written Opinion for PCT/FI2015/050603 dated Jun. 8, 2016.
International Preliminary Report on Patentability for PCT/FI2015/050603 dated Sep. 15, 2017.

* cited by examiner

CRUSHER FRAME

CROSS-REFERENCE TO RELATED APPLICATIONS

This application is the U.S. national stage application of International Application PCT/FI2015/050603 filed Sep. 14, 2015, which international application was published on Mar. 23, 2017, as International Publication WO 2017/046437 in the English language.

TECHNICAL FIELD

The invention relates to mineral material processing. In particular, but not exclusively, the invention relates to gyratory and cone crushers. In particular, but not exclusively, the invention relates to an upper frame of a gyratory crusher.

BACKGROUND ART

Gyratory and cone crushers are used in processing of mineral material such as stone.

A gyratory crusher comprises a frame comprising an upper frame and a lower frame. The mineral material is crushed in a crushing cavity between an outer crushing member that is conventionally fixed to the frame of the gyratory crusher and an inner crushing member mounted on an oscillating shaft assembly. The main shaft of the oscillating shaft assembly is supported at the top with support arms, also known as a spider or spider arms, as well as being supported from the bottom by a support structure. The support arms of the upper frame and the upper frame opening define a feed opening through which mineral material to be processed is fed into the crushing cavity.

The structure of a mineral material processing plant and the crusher comprised therein need to be able to withstand large and fluctuating stresses and impacts. Accordingly, the frame of a crusher needs to have as strong a structure as possible and on the other hand provide for easy use, installation and maintenance and not be excessively heavy.

From patent publication US2011192927A1 there is known a spider arm assembly in which the spider arms have a generally u-shaped cross-section.

It is the object of the invention to provide an improved upper frame of a crusher.

SUMMARY

According to a first example aspect of the invention there is provided an upper frame for a crusher, comprising a central hub for receiving a main shaft of the crusher;

an upper rim; and a spider arm; wherein a u-shaped cavity extends towards a lower flange from the upper rim.

The u-shaped cavity may extend from the upper rim to the lower flange.

The upper rim may comprise an upper flange.

The spider arm may comprise walls having inner walls and outer walls and a bottom.

The u-shaped cavity may be defined in the spider arm by the inner walls and the bottom and may extend from the central hub at least below the upper rim.

The upper flange may interrupt the u-shaped cavity.

The upper frame may further comprise attaching means for wear parts.

The edge of the u-shaped cavity may be formed in such a way as to form a curve together with the attaching means next to the u-shaped cavity.

The attaching means may be joined together forming a ring-like protrusion.

The upper frame may further comprise attaching means for a lifting tool.

The attaching means may comprise cast brackets.

The surface of the bottom of the u-shaped cavity may have a continuous curve form from the upper rim to the central hub and/or from the lower flange to the upper rim.

The diameter of the upper frame may increase substantially continuously towards the lower flange.

According to a second example aspect of the invention there is provided a cone or gyratory crusher comprising the upper frame of the first example aspect.

According to a third example aspect of the invention there is provided a mineral material processing plant comprising the crusher the second example aspect.

The mineral material processing plant may be a mobile processing plant.

Different embodiments of the present invention will be illustrated or have been illustrated only in connection with some aspects of the invention. A skilled person appreciates that any embodiment of an aspect of the invention may apply to the same aspect of the invention and other aspects alone or in combination with other embodiments as well.

BRIEF DESCRIPTION OF THE DRAWINGS

The invention will be described, by way of example, with reference to the accompanying schematical drawings, in which.

DETAILED DESCRIPTION

Figure 1:
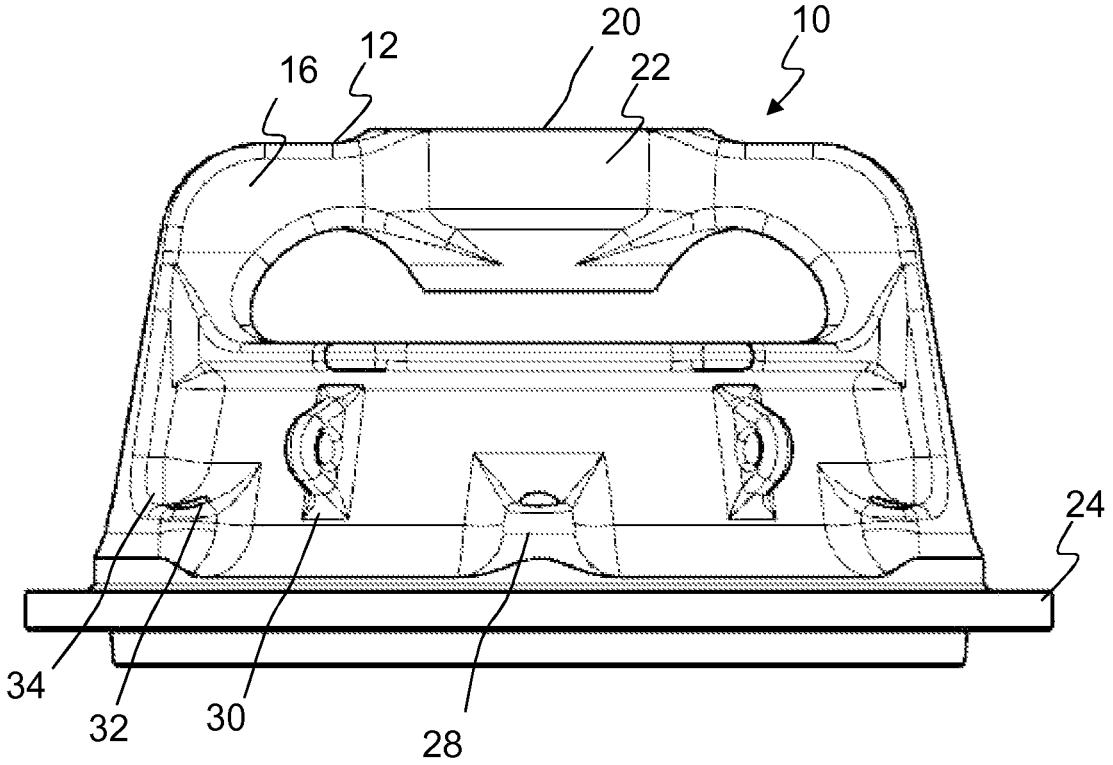
FIG. 1 shows a side view of an upper frame according to an embodiment of the invention.
Figure 2:
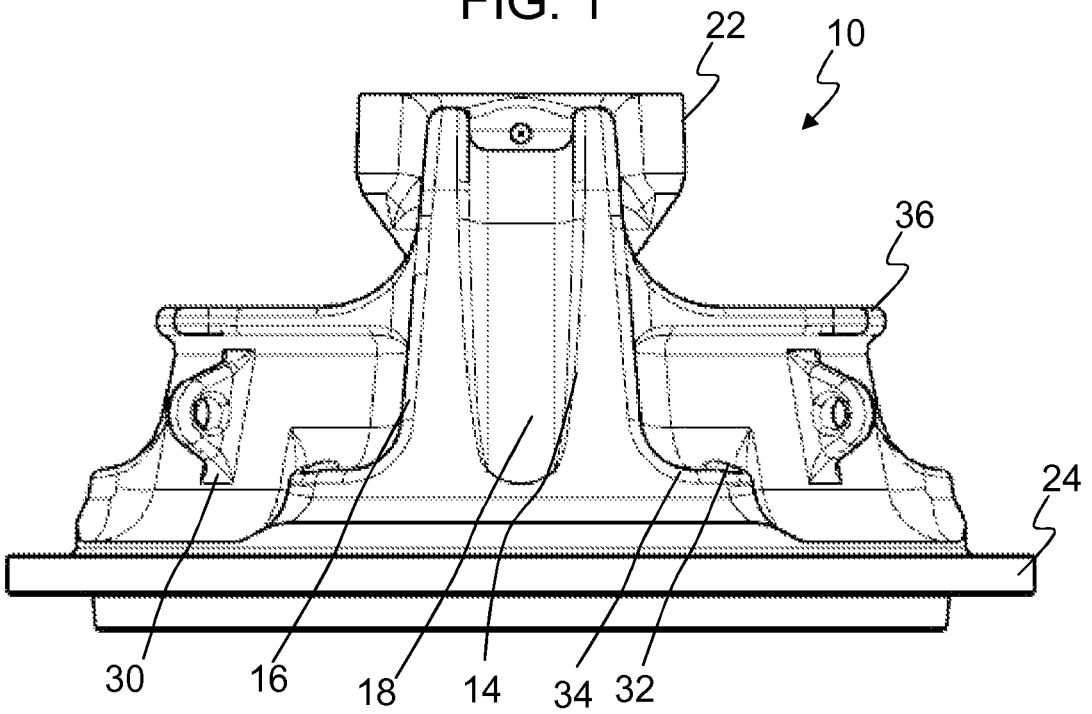
FIG. 2 shows a side view of an upper frame according to an embodiment of the invention.
Figure 3:
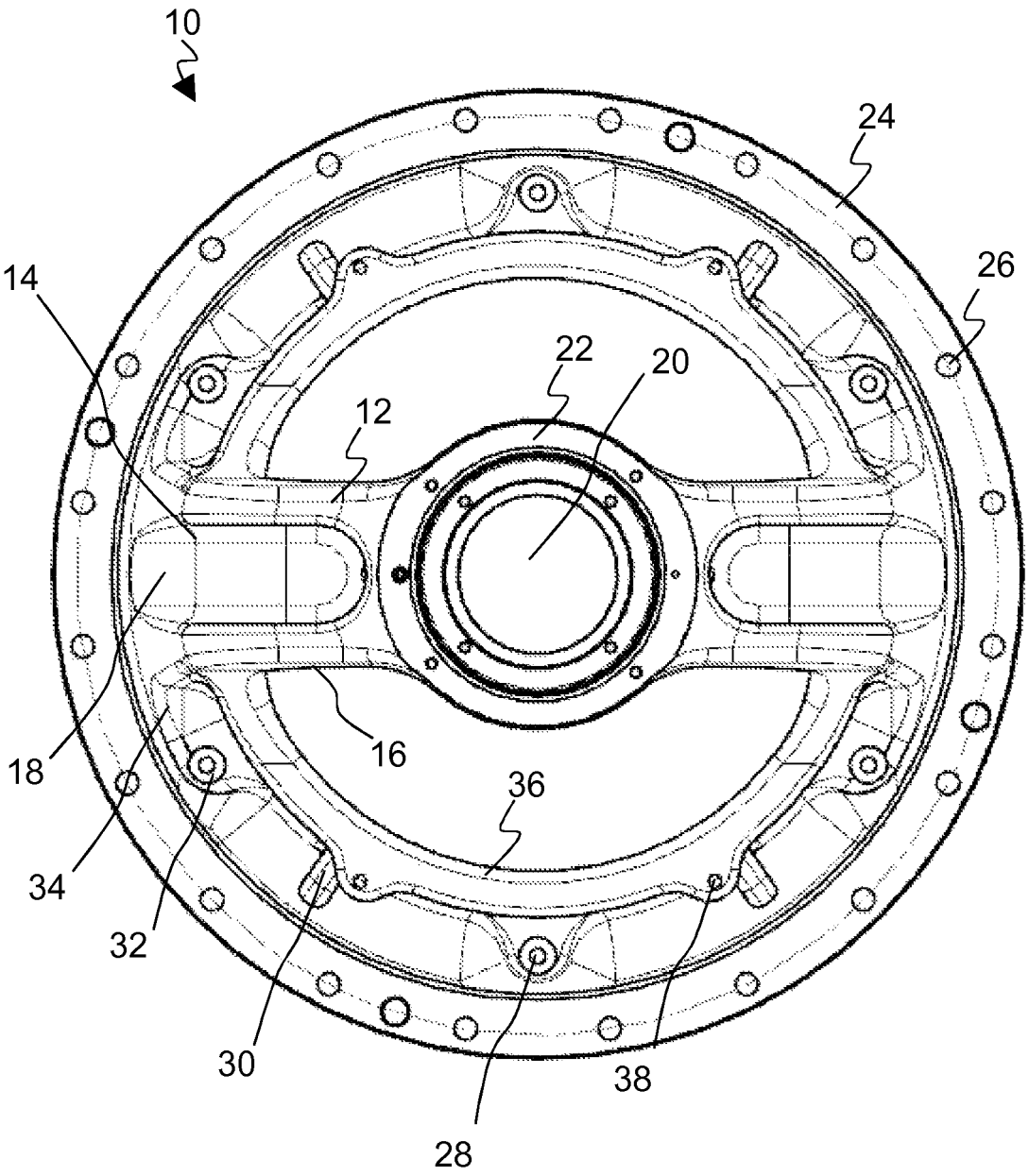
FIG. 3 shows a top view of an upper frame according to an embodiment of the invention.
Figure 4:
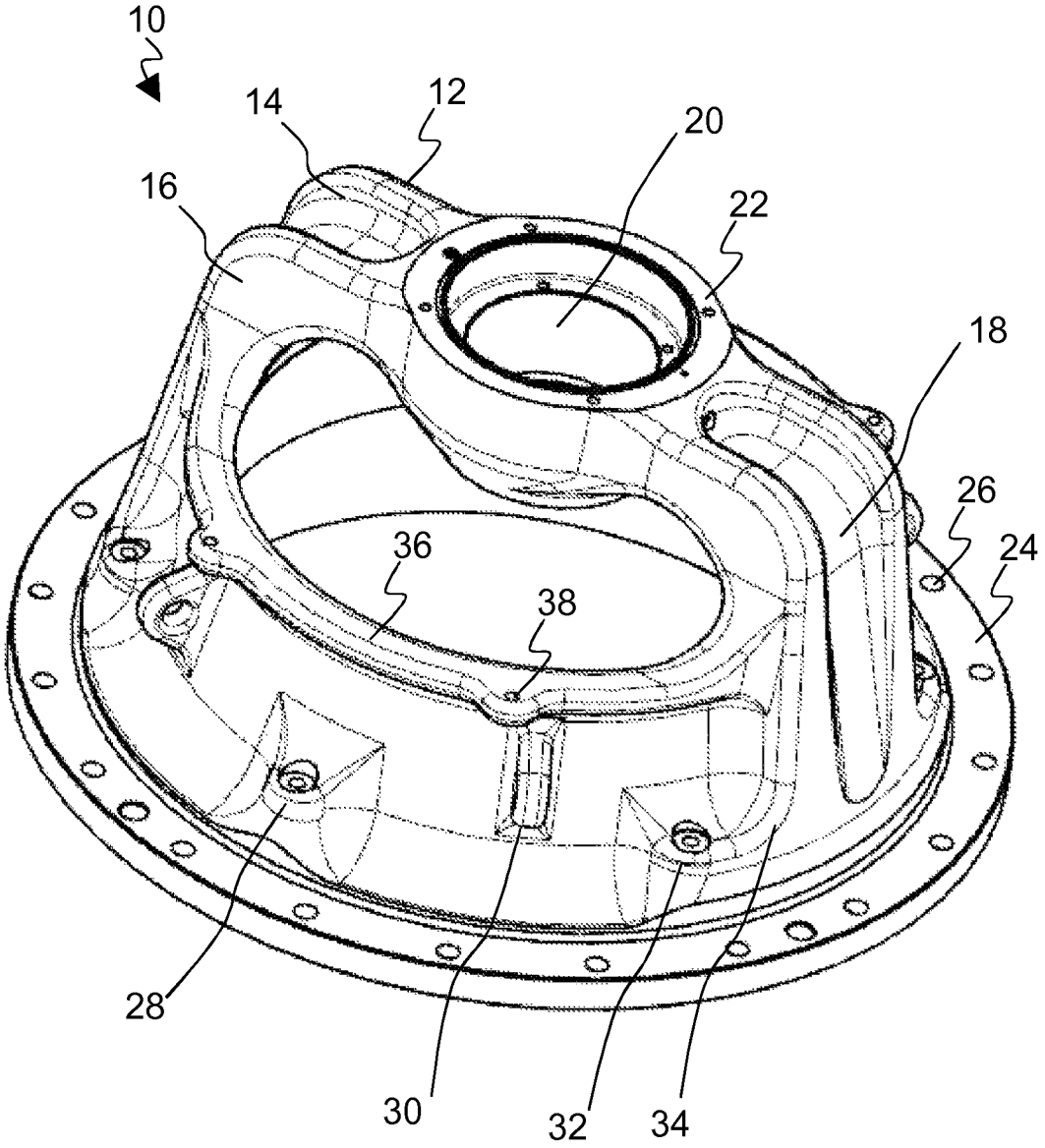
FIG. 4 shows a view of an upper frame according to an embodiment of the invention.
Figure 5:
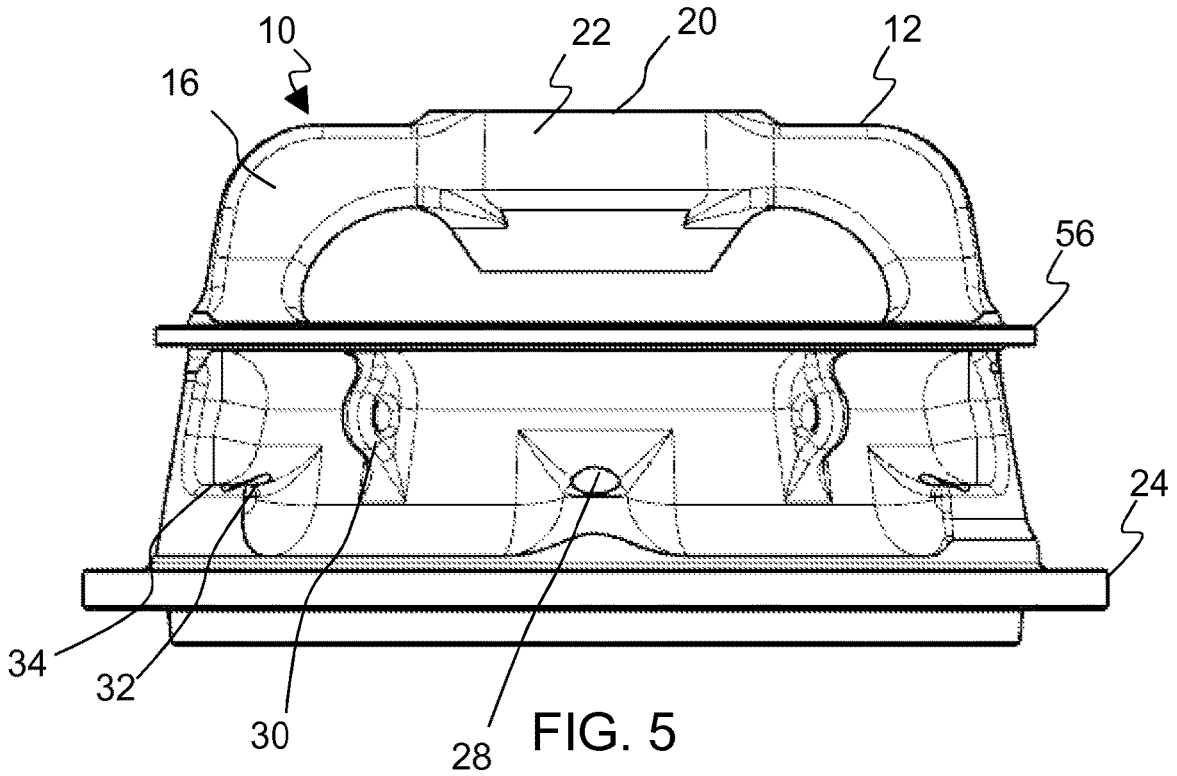
FIG. 5 shows a side view of an upper frame according to an embodiment of the invention.
Figure 6:
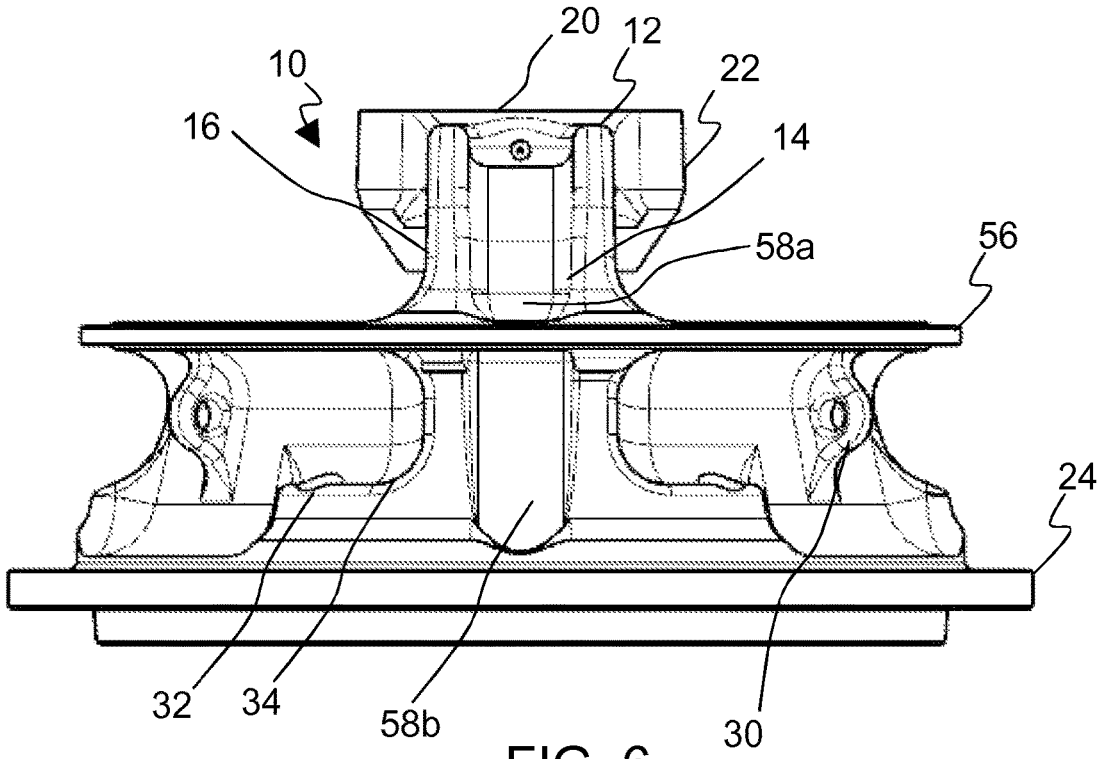
FIG. 6 shows a side view of an upper frame according to an embodiment of the invention.
Figure 7:
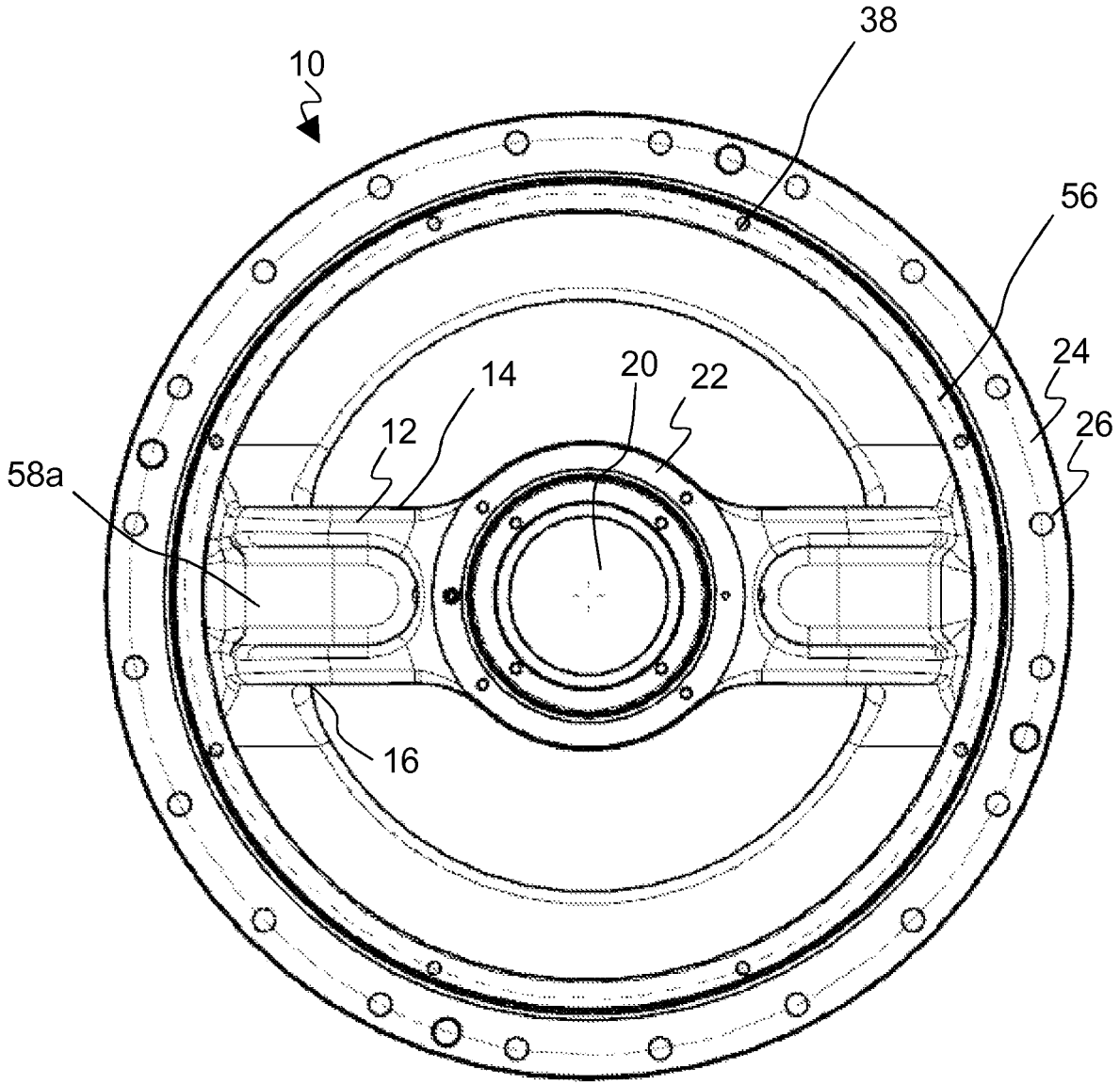
FIG. 7 shows a top view of an upper frame according to an embodiment of the invention.
Figure 8:
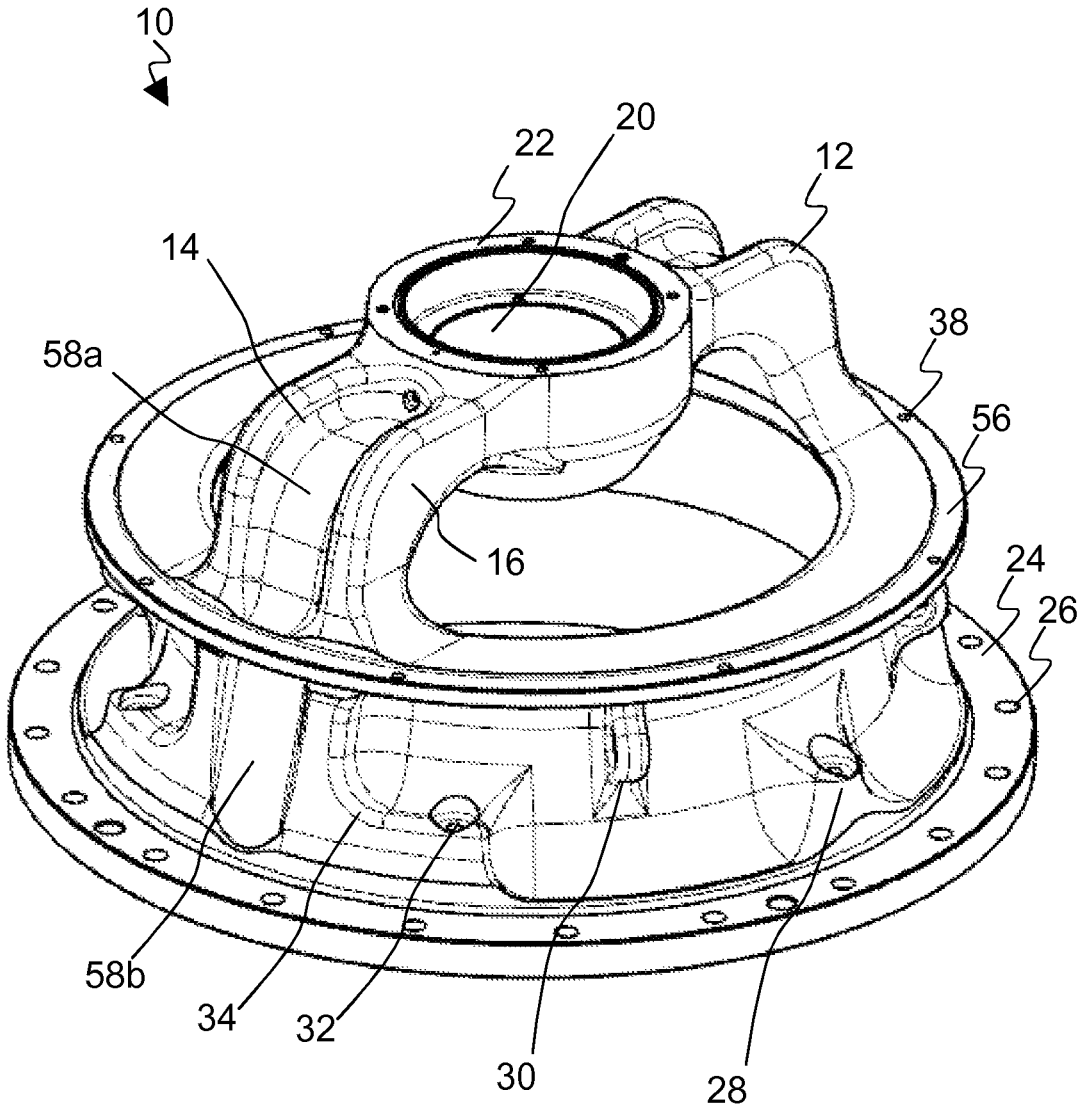
FIG. 8 shows a view of an upper frame according to an embodiment of the invention.

In the following description, like numbers denote like elements. It should be appreciated that the illustrated drawings are not entirely in scale, and that the drawings mainly serve the purpose of illustrating some example embodiments of the invention.

FIGS. 1 to 4 show an upper frame according to an embodiment of the invention. FIGS. 1 to 4 show an upper frame 10 comprising a lower flange 24, a spider arm structure, i.e. spider arm or arm, 12 and a central hub 22 with a hole 20 for the main shaft of the crusher. The spider arm structure extends from the central hub 22 to the upper rim 36. In an embodiment, the upper frame 10 is shaped in such a way that the diameter thereof increases substantially continuously towards the lower flange 24 of the upper frame 10, i.e. the upper frame expands in a downward direction. A u-shaped cavity extends from the upper rim 36 towards the lower flange 24. In a further embodiment, the u-shaped cavity extends from the upper rim to the lower flange 24.

The spider arm structure 12, in an embodiment, comprises side walls with inner walls 14 and outer walls 16, and a bottom 18. The spider arm 12 is arranged in the same manner on both sides of the central hub 22 as well as symmetrically with respect to the longitudinal diagonal thereof. In an embodiment, the inner surface of the arm is rounded, i.e. the lower surface curves substantially continuously both in longitudinal and crosswise directions thus providing space for material to be crushed while reducing tension on the spider arms. In an embodiment, a substantially u-shaped cavity is defined or formed in the spider arm 12 by the inner walls 14 and the bottom, i.e. a cavity open in a direction away from the bottom 18. It is to be noted that the exact shape of the cross-section of the cavity is in an embodiment chosen in accordance with the situation, i.e. the angles of the side walls 14 and the beveling or rounding of the corners may vary in accordance with the situation, so that the cross-section is u-shaped in the sense that the bottom 18 and the inner walls 14 define therebetween a cavity with a bottom and walls rising thereof, wherein the cross-section then resembles the letter U. The u-shape of the cavity provides for a reduced wall thickness and thus for an easier and less error prone casting of the upper frame.

The u-shaped cavity formed by the side walls 14 and the bottom 18 extends from the central hub 22 to the lower flange 24, i.e. both the horizontal and vertical portions of the arm comprise the u-shaped cavity, thus providing a strong structure while decreasing the weight of the upper frame 10. In a further embodiment, the u-shaped cavity formed by the side walls 14 and the bottom 18 extends from the central hub 22 at least below the upper rim 36. In an embodiment, the thickness of the bottom 18 and the distance thereof from the vertical centerline of the central hub 22 increases towards the bottom flange 24. In an embodiment, the surface of the bottom 18 of the u-shaped cavity has a continuous curve form from the upper rim 36 to the central hub 22 and/or from the lower flange 24 to the upper rim 36.

The upper frame 10 further comprises attaching means, e.g. holes, 26 for attaching the upper frame to a lower frame of a crusher and brackets, or lugs, 30 fro attaching a lifting tool to the upper frame 10. As the brackets 30 have been formed integrally with the upper frame 10, there is no need for separate attachment means such as bolts or welded attachments during manufacture, service or transport. The upper frame further comprises an upper rim 36 defining, together with the arm structure 12 and the central hub 22 a feed opening. The upper rim 36 comprises attaching means, e.g. holes, 38 for attaching a feed chute, or feed hopper, to the upper frame 10.

The upper frame 10 further comprises attaching means, e.g. brackets with holes, 28,32 for attaching wear parts, i.e. a crushing shell, to the upper frame 10. In an embodiment, the outer walls 16 of the arm are formed in such a way as to form a curve 34 together with the attaching means 32 next to the arm thus further strengthening the structure of the upper frame 10. The curve 34 provides for a stronger structure of the upper frame in strengthening the structure of the attaching means 32. In a further embodiment, the attaching means 28,32 are all joined together forming a ring-like protrusion thus further strengthening the structure of the upper frame 10.

In a further embodiment, the upper frame 10 comprises further elements not shown in FIGS. 1 to 4, such as vertical strengthening ribs and further attaching means. In an embodiment, the whole upper frame is manufactured as a single piece.

FIGS. 5 to 8 show an upper frame according to an embodiment of the invention. FIGS. 5 to 8 show an upper frame 10 comprising a lower flange 24, a spider arm structure, i.e. spider arm or arm, 12 and a central hub 22 with a hole 20 for the main shaft of the crusher. The spider arm structure extends from the central hub 22 to the upper rim 36. In an embodiment, the inner surface of the arm is rounded, i.e. the lower surface curves substantially continuously both in longitudinal and crosswise directions thus providing space for material to be crushed while reducing tension on the spider arms. In an embodiment, the upper frame 10 is shaped in such a way that the diameter thereof increases substantially continuously towards the lower flange 24 of the upper frame 10, i.e. the upper frame expands in a downward direction. A u-shaped cavity extends from the upper rim 36 towards the lower flange 24. In a further embodiment, the u-shaped cavity extends from the upper rim to the lower flange 24.

The upper frame further comprises at the upper rim an upper flange 56 defining, together with the arm structure 12 and the central hub 22 a feed opening. The upper flange 56 comprises attaching means, e.g. holes, 38 for attaching a feed chute, or a feed hopper, to the upper frame 10. The upper flange 56 provides for an easier attachment of the feed chute or the feed hopper. In an embodiment, the upper flange 56 interrupts the u-shaped cavity, i.e. forms a complete ring around the upper frame 10.

The spider arm structure 12, in an embodiment, comprises side walls with inner walls 14 and outer walls 16, and a bottom 58*a*,58*b*. The spider arm 12 is arranged in the same manner on both sides of the central hub 22 as well as symmetrically with respect to the longitudinal diagonal thereof. In an embodiment, a substantially u-shaped cavity is defined or formed in the spider arm 12 by the inner walls 14 and the bottom 58*a*,58*b*, i.e. a cavity open in a direction away from the bottom 58*a*,58*b*. It is to be noted that the exact shape of the cross-section of the cavity is in an embodiment chosen in accordance with the situation, i.e. the angles of the side walls 14 and the beveling or rounding of the corners may vary in accordance with the situation, so that the cross-section is u-shaped in the sense that the bottom 58*a*,58*b* and the inner walls 14 define therebetween a cavity with a bottom and walls rising thereof, wherein the cross-section then resembles the letter U. The u-shape of the cavity provides for a reduced wall thickness and thus for an easier and less error prone casting of the upper frame. In an embodiment, the surface of the bottom 58*a*,58*b* of the u-shaped cavity has a continuous curve form from the upper rim 36 to the central hub 22 and/or from the lower flange 24 to the upper rim 36

The u-shaped cavity formed by the side walls 14 and the bottom 58*a*,58*b* extends from the central hub 22 to the lower flange 24, i.e. both the horizontal and vertical portions of the arm comprise the u-shaped cavity, thus providing a strong structure while decreasing the weight of the upper frame 10. In a further embodiment, the u-shaped cavity formed by the side walls 14 and the bottom 18 extends from the central hub 22 at least below the upper flange 56. In an embodiment, the thickness of the bottom 18 and the distance thereof from the vertical centerline of the central hub 22 increases towards the bottom flange 24. In an embodiment, the upper flange 56 interrupts the u-shaped cavity, but the cavity on both sides of the upper flange 56 has the u-shaped cross-section. As the u-shaped cavity extends to the lower flange 24, or at least below the upper flange 56, forces affecting the upper frame are divided more evenly between the upper flange 56 and the lower flange 24.

The upper frame 10 further comprises attaching means, e.g. holes, 26 for attaching the upper frame to a lower frame of a crusher and brackets, or lugs, 30 fro attaching a lifting tool to the upper frame 10. As the brackets 30 have been formed integrally with the upper frame 10, there is no need for separate attachment means such as bolts or welded attachments during manufacture, service or transport.

The upper frame 10 further comprises attaching means, e.g. brackets with holes, 28,32 for attaching wear parts to the upper frame 10. In an embodiment, the outer walls 16 of the arm are formed in such a way as to form a curve 34 together with the attaching means 32 next to the arm thus further strengthening the structure of the upper frame 10. The curve 34 provides for a stronger structure of the upper frame in strengthening the structure of the attaching means 32. In a further embodiment, the attaching means 28,32 are all joined together forming a ring-like protrusion thus further strengthening the structure of the upper frame 10.

In a further embodiment, the upper frame 10 comprises further elements not shown in FIGS. 5 to 8, such as horizontal strengthening ribs and further attachment means. In an embodiment, the whole upper frame is manufactured as a single piece.

Figure 9:
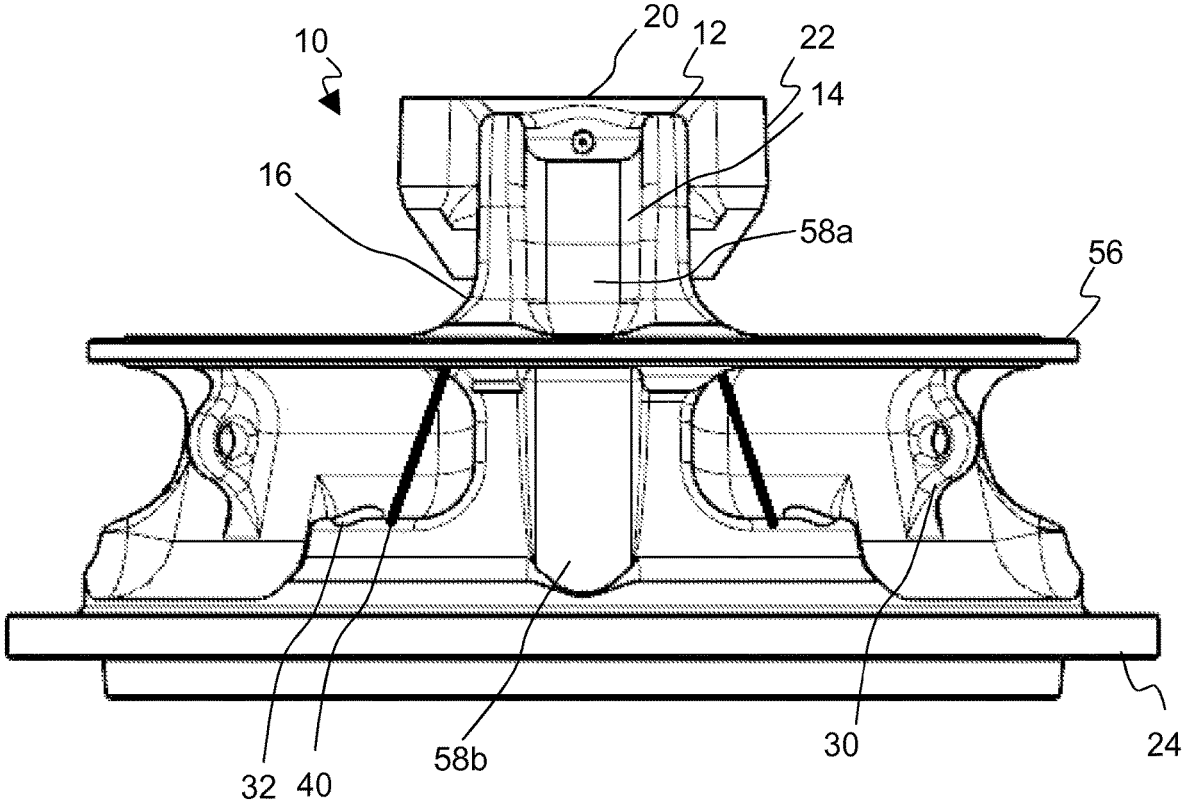
FIG. 9 shows a side view of an upper frame according to an embodiment of the invention.

FIG. 9 shows an upper frame according to an embodiment of the invention. The upper frame of FIG. 9 has similar elements as that of FIGS. 5-8. In addition, the outer walls 16 are formed in such a way as to have an A-shaped structure 40, i.e. the lower part of the outer walls extends away from the u-shaped cavity.

Figure 10:
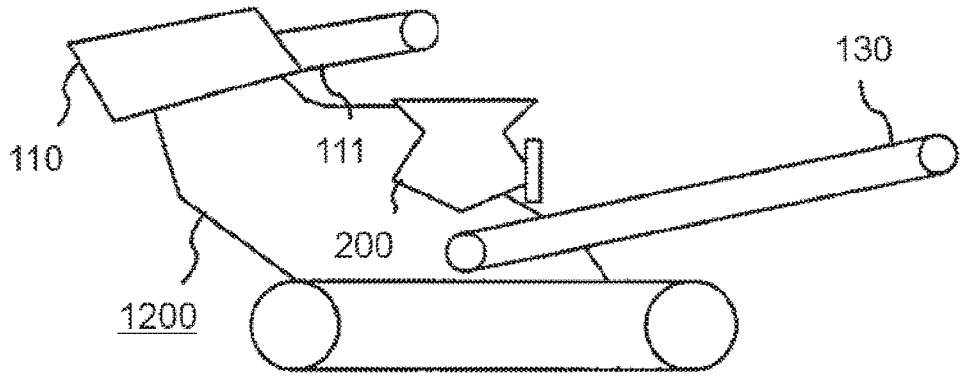
FIG. 10 shows a schematic view of a mobile mineral material processing plant according to an embodiment of the invention.

FIG. 10 shows a mobile mineral material processing plant 1200 according to an embodiment of the invention. The processing plant comprises wheels or tracks for moving the plant on the ground, a crusher 200, a discharge conveyor 130 and a feeding system such as a feeder and/or a conveyor 110, 111 for feeding material to. The processing plant is preferably a self-propelled crushing plant.

Figure 11:
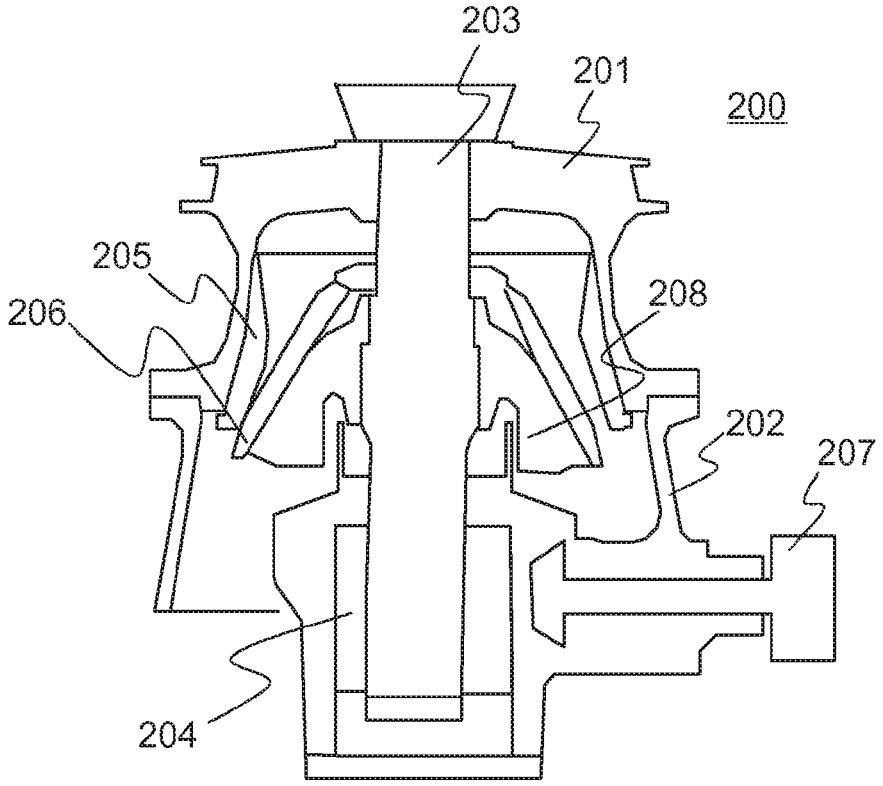
FIG. 11 shows a crusher according to an embodiment the invention.

FIG. 11 shows a crusher 200 according to an embodiment of the invention. The crusher comprises a frame, an upper frame 201 and a lower frame 202, a main shaft 203, an eccentric assembly 204, an outer crushing part 205, an inner crushing part 206, a transmission 207 and a crusher head 208.

The transmission is arranged to rotate the eccentric assembly around the main shaft producing gyratory movement between the inner and the outer crushing parts.

Without in any way limiting the scope, interpretation, or application of the claims appearing below, a technical effect of one or more of the embodiments disclosed herein is an improved strength of the upper frame. Another technical effect of one or more of the example embodiments disclosed herein is reduced weight of the upper frame without compromising the strength of the structure. Another technical effect of one or more of the example embodiments disclosed herein is easier maintenance of the upper frame. A still further technical effect of one or more of the example embodiments disclosed herein is an easier manufacture of the upper frame. A still further technical effect of one or more of the example embodiments disclosed herein is that the crushing forces are spread more evenly between the regions of the upper and lower flanges respectively.

The foregoing description provides non-limiting examples of some embodiments of the invention. It is clear to a person skilled in the art that the invention is not restricted to details presented, but that the invention can be implemented in other equivalent means.

Some of the features of the above-disclosed embodiments may be used to advantage without the use of other features. As such, the foregoing description shall be considered as merely illustrative of principles of the invention, and not in limitation thereof. Hence, the scope of the invention is only restricted by the appended patent claims.

The invention claimed is:

1. An upper frame for a crusher, comprising:
- a central hub for receiving a main shaft of the crusher;
- an upper rim located radially outward from and below the central hub and extending around the central hub at a first distance below the central hub;
- a lower flange located below the upper rim and extending around the central hub at a second distance below the central hub; and
- at least one spider arm extending from the central hub to the upper rim; wherein
- the upper rim is located at a distance radially outward of the at least one spider arm;
- the at least one spider arm includes an outwardly open u-shaped cavity formed in an outer surface of the at least one spider arm, wherein the u-shaped cavity extends towards the lower flange from the upper rim and the u-shaped cavity is defined in the at least one spider arm by inner walls and a bottom, wherein the u-shaped cavity extends from the central hub to at least below the upper rim.

2. The upper frame of claim 1, wherein the u-shaped cavity extends from the upper rim to the lower flange.

3. The upper frame of claim 1, wherein the upper rim comprises an upper flange.

4. The upper frame of claim 1, further comprising attaching means for wear parts.

5. The upper frame of claim 4, wherein an edge of the u-shaped cavity is formed in such a way as to form a curve together with the attaching means next to the u-shaped cavity.

6. The upper frame of claim 1, further comprising attaching means for a lifting tool.

7. The upper frame of claim 6, wherein the attaching means comprise cast brackets.

8. The upper frame of claim 1, wherein a bottom surface of the u-shaped cavity has a continuous curve form from the upper rim to the central hub and/or from the lower flange to the upper rim.

9. The upper frame of claim 1, wherein the diameter of the upper frame increases between the central hub and the lower flange.

10. A cone or gyratory crusher, comprising:
- a main shaft;
- an eccentric assembly mounted to the main shaft and coupled to a transmission operable to impart gyratory movement to the main shaft;
- a crusher head mounted to the main shaft;
- an outer crushing part spaced from the crusher head; and
- the upper frame of claim 1.

11. The upper frame of claim 1 wherein the u-shaped cavity includes a lower surface that is curved in both a longitudinal and crosswise direction.

12. The upper frame of claim 1 where the upper frame is formed as a single piece.

* * * * *